US005308360A

United States Patent [19]

Neitzke et al.

[11] Patent Number: 5,308,360

[45] Date of Patent: May 3, 1994

[54] KEY STORAGE CONTAINER

[75] Inventors: William J. Neitzke; G. Lynn Hagen, both of Paradise Valley, Ariz.

[73] Assignee: Axxess Entry Technologies, Inc., Tempe, Ariz.

[21] Appl. No.: 991,296

[22] Filed: Dec. 16, 1992

[51] Int. Cl.[5] ..... B65H 1/00

[52] U.S. Cl. ..... 221/197; 221/312 R

[58] Field of Search ..... 221/232, 312 R, 268, 221/261, 197, 93, 152; 312/60, 61, 184; 206/37.1

[56] References Cited

U.S. PATENT DOCUMENTS

| | | | |
|---|---|---|---|
| 2,678,253 | 5/1954 | Rosenberg | 312/285 |
| 3,568,883 | 3/1971 | Reynolds | 221/305 |
| 3,586,206 | 6/1971 | Gilmore | 221/89 |
| 4,043,485 | 8/1977 | Tippetts | 221/312 |
| 4,609,975 | 9/1986 | Badolato et al. | 362/128 |
| 4,653,649 | 3/1987 | Holdredge, Jr. | 211/41 |
| 4,700,850 | 10/1987 | Morgan et al. | 211/131 |
| 5,056,683 | 10/1991 | O'Brien | 221/312 R |

*Primary Examiner*—Robert P. Olszewski
*Assistant Examiner*—Kenneth Noland
*Attorney, Agent, or Firm*—Cahill, Sutton & Thomas

[57] ABSTRACT

A key storage container receives, stores and dispenses along a longitudinal axis a supply of identical key storage tags, each of which holds a key blank. The key storage container includes a horizontally oriented base and vertically oriented sidewalls. The sidewall includes a first sidewall segment aligned with and extending vertically upward from the front of the base as well as a second sidewall segment which completes the vertically oriented sidewall of the key storage container. A dispensing aperture is located at the junction of the first sidewall segment with the base and includes a height and width sufficient to allow the maximum cross sectional area of the lowest key storage tag stacked within the storage volume of the key storage container to be longitudinally displaced along the base of the storage volume through the dispensing aperture.

19 Claims, 6 Drawing Sheets

KEY STORAGE CONTAINER

BACKGROUND OF THE INVENTION

1. Field of the Invention

This invention relates to key storage containers, and more particularly, to key storage containers for receiving, storing and dispensing key storage tags each of which includes a key blank.

2. Description of the Prior Art

In a typical prior art locksmith operation, key blanks are stored on multi-panel, carousal storage racks where each panel includes a series of horizontally protruding hooks for holding key blanks having varying geometry.

Over a period of time, the locksmith depletes his inventory of particular key blanks and orders replacements. The replacement key blanks typically arrive in plastic baggies or conventional cardboard boxes each of which includes a number of identical key blanks. The locksmith then must open each baggie or box, remove the group of identical key blanks, locate the proper key blank carousel hook and thereby restock his inventory of key blanks.

The foregoing procedure is time consuming and subject to error, particularly the step of matching the new key blank inventory with the particular key blank hook.

SUMMARY OF THE INVENTION

It is therefore a primary object of the present invention to provide a key storage container capable of receiving, storing and dispensing along a longitudinal axis a supply of identical key storage tags, each of which includes an identical key blank.

Another object of the present invention is to provide a key storage container including a storage volume for holding the supply of key storage tags in alignment in a vertical stack including a lowest key storage tag supported directly by the base of the key storage container.

Another object of the present invention is to provide a key storage container which includes a dispensing aperture at its base for allowing the lowest key storage tag to be longitudinally displaced along the base of the storage volume through the dispensing aperture.

Another object of the present invention is to provide a key storage container which includes a set of ten identical, vertically stacked key storage tags, each including an identical key blank.

Briefly stated, and in accord with one embodiment of the invention, a key storage container receives, stores and dispenses along a longitudinal axis a supply of identical key storage tags each of which holds a key blank having a first area. Each key storage tag includes a length, a front edge, a rear edge, opposing side edges defining a width, a second area greater than the first area and a maximum cross sectional area. The key storage container includes a horizontally oriented base defining a third area greater than the second area as well as a front edge and a perimeter edge. A vertically oriented sidewall includes a sidewall height and further includes a first sidewall segment and a second sidewall segment. The first sidewall segment is aligned with and extends vertically upward from the base front edge and includes first and second edge surfaces. The second sidewall segment is coupled to and extends vertically upward from the base and is coupled to the first and second edge surfaces of the first sidewall segment. The second sidewall segment defines a storage volume for holding the supply of key storage tags in alignment in a vertical stack which includes a lowest key storage tag supported directly by the base. A dispensing aperture is located at the junction of the first sidewall segment at the base and includes a height and a width sufficient to allow the maximum cross sectional area of the lowest key storage tag to be longitudinally displaced along the base of the storage volume through the dispensing aperture.

DESCRIPTION OF THE DRAWINGS

The invention is pointed out with particularity in the appended claims. However, other objects and advantages together with the operation of the invention may be better understood by reference to the following detailed description taken in connection with the following illustrations, wherein:

DESCRIPTION OF THE PREFERRED EMBODIMENT

In order to better illustrate the advantages of the invention and its contributions to the art, a preferred hardware embodiment of the invention will now be described in some detail.

Figure 1:
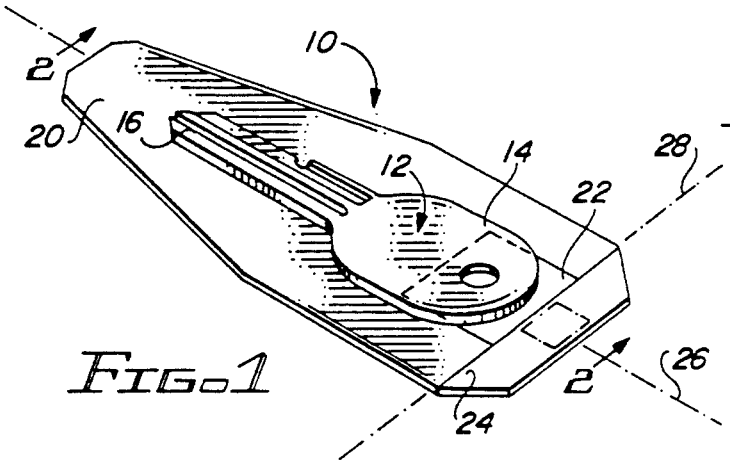
FIG. 1 is a perspective view of a key storage tag of the present invention showing the key storage tag in the key blank storage configuration.
Figure 2:
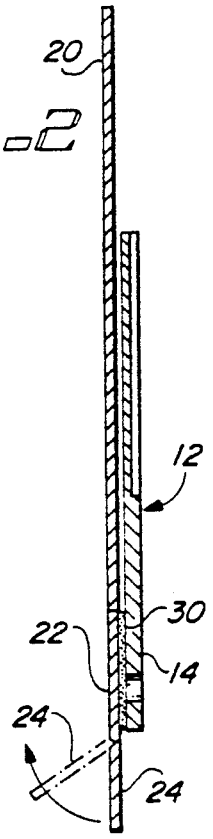
FIG. 2 is a sectional view of the key storage tag illustrated in FIG. 1, taken along section lines 2—2.
Figure 3:
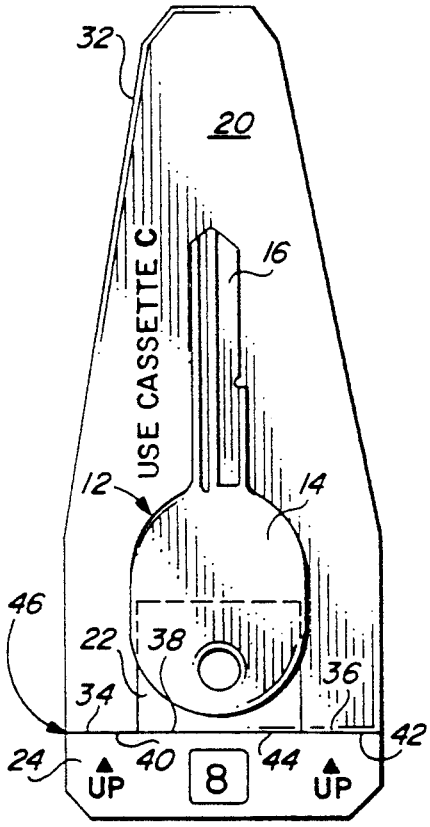
FIG. 3 is a view from above of the key storage tag illustrated in FIG. 1.

Referring now to FIGS. 1, 2 and 3, key storage tag 10 is designed to store a key blank 12 having a key head 14 and a key blade 16.

Figure 8:
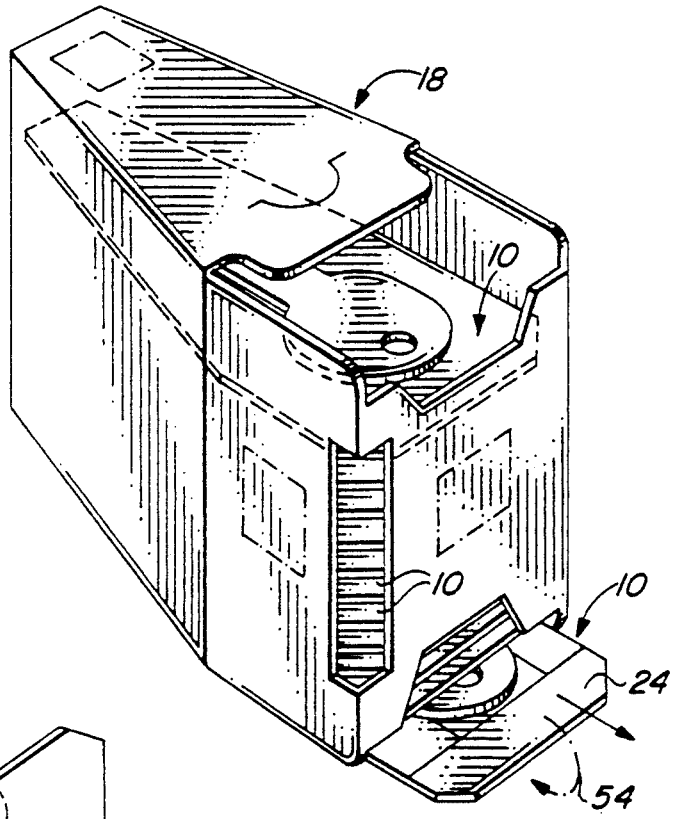
FIG. 8 is a perspective view of a key storage container configured to receive and store a plurality of key storage tags.

As illustrated in FIG. 8, a plurality of key storage tags 10 are designed to fit within an internal storage cavity of a key storage container 18. To facilitate such dimensional compatibility, the area of key storage tag 10 is configured to approximately equal or be slightly less than the cross sectional area of the internal storage cavity of key storage container 18 as illustrated in FIG. 8.

As illustrated in FIGS. 1, 2 and 3, key storage tag 10 includes a substantially planar tag main body 20, a key to tag interface 22 and a junction body 24.

Key storage tag 10 includes a longitudinal axis 26 which is typically laterally aligned with the longitudinal axis or centerline of key blank 12.

Key storage tag 10 also includes a lateral axis 28 which separates junction body 24 from tag main body 20 and key to tag interface 22.

FIG. 2 illustrates that means 30 serves to detachably couple key to tag interface 22 to the lower surface of the head 14 of key blank 12. In the preferred embodiment of the present invention, detachable coupling means 30 takes the form of a thin, substantially rectangular plastic sheet coated on both the upper and lower surfaces with an adhesive material to thereby adhesively couple key head 14 to the upper side of the plastic sheet and to similarly adhesively couple the lower surface of the plastic sheet to the upper surface of key to tag interface 22. In alternative embodiments of the invention, standardized double-sided adhesive tape or an area of solid or fluid adhesive without any related sheet material could also easily be substituted to serve as the detachable coupling means of the present invention. Preferably, the adhesive selected will be one which readily allows the key blank to be peeled away from the adhesive following termination of the key duplicating procedures.

As described in connection with FIG. 8, the key storage tag 10 as illustrated in FIG. 3 includes a perimeter 32 dimensioned to fit within the storage cavity of key storage container 18. As also shown, tag main body 20 is substantially planar and includes first and second spaced apart linear junction elements 34 and 36 which serve as an interface between tag main body 20 and junction body 24.

Key to tag interface 22 also includes a third junction element 38 which serves as an interface between key to tag interface 22 and junction body 24.

Although in FIG. 3, first, second and third junction elements 34, 36 and 38 are shown as running linearly from one edge of the tag to the opposite edge of the tag, these elements of the invention could be configured differently, potentially having shorter lengths with spaces in between the various elements or in various other configurations which would be readily apparent to one of ordinary skill in the art.

Junction body 24 includes corresponding junction interfaces designated as first junction segment 40, second junction segment 42 and third junction segment 44. Each of these junction segments of junction body 24 interface with and join the corresponding junction elements of key tag main body 20 and key to tag interface 22 as illustrated in the drawings.

Figure 4:
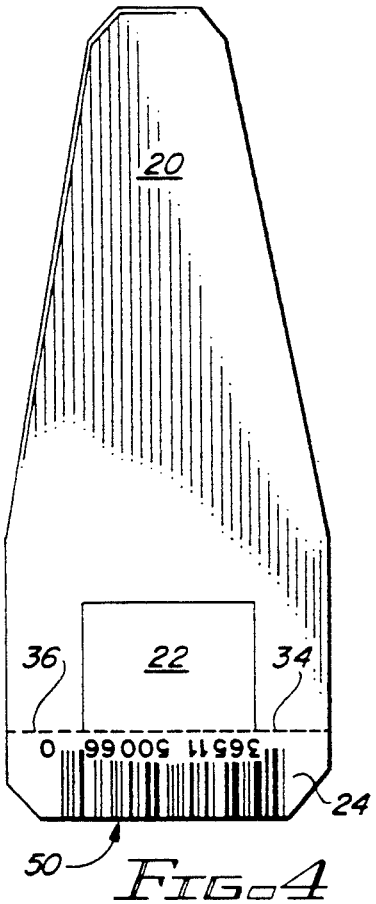
FIG. 4 is a view from below of the key storage tag illustrated in FIG. 1.
Figure 5:
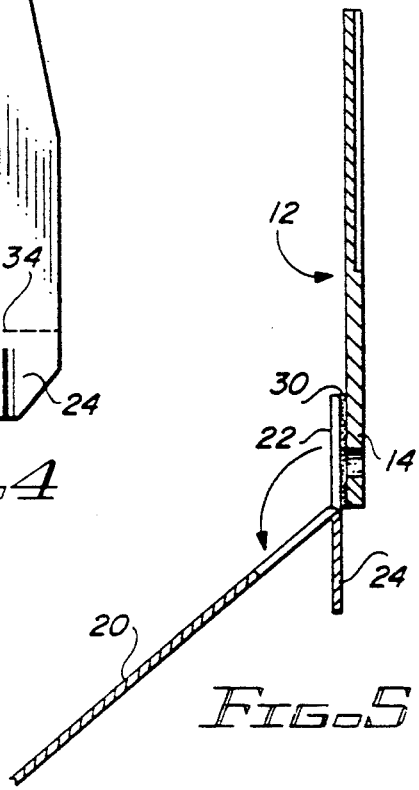
FIG. 5 is a side elevational view of the key storage tag illustrated in FIG. 1 showing the key storage tag deflected into the key duplication configuration relative to the key blank.
Figure 6:
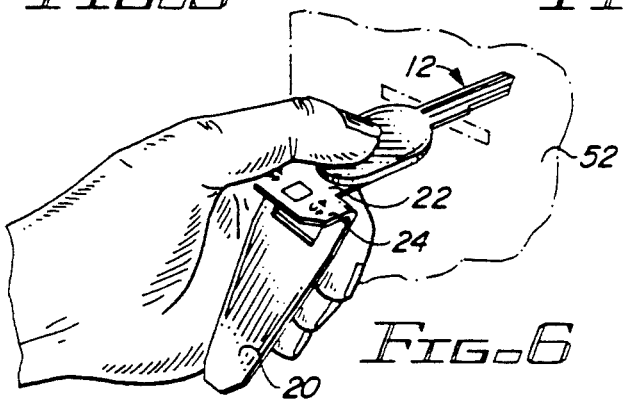
FIG. 6 illustrates the manner in which the key storage tag can be deflected into the key duplication configuration and inserted into a key duplication cassette of a key cutting machine.
Figure 9:
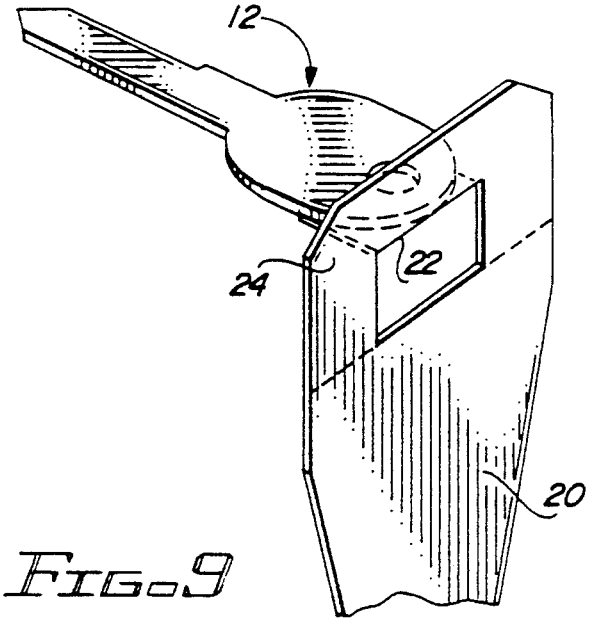
FIG. 9 illustrates a second embodiment of the invention including a hinge which pivots differently from the hinge illustrated in FIG. 6.

A hinge generally designated by reference number 46 is aligned with lateral axis 28 and enables the tag main body 20 to be deflected between a key blank storage configuration illustrated in FIGS. 1-4 where tag main body 20 is positioned substantially parallel to key blank 12 and a key duplication configuration illustrated in FIGS. 5, 6 and 9 wherein tag main body 20 is deflected away and separated from the lower surface of key blank 12.

FIGS. 5 and 6 illustrate one specific configuration of hinge 46 in which key to tag interface 22 and junction body 24 remain in the same plane while tag main body 20 is angularly deflected relative to that plane.

In a second slightly different embodiment of the invention as illustrated in FIG. 9, the hinging action occurs in a different way which maintains tag main body 20 and junction body 24 in the same plane while the hinging action occurs by deflection of the key to tag interface 22 relative to those elements along the third junction element 38 and third junction segment 44.

Although either embodiment of the hinge of the present invention operates quite well, the preferred embodiment of the invention uses the hinging action illustrated in FIGS. 5 and 6.

Figure 7:
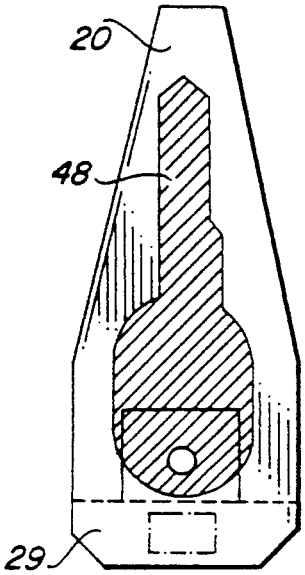
FIG. 7 is a view from above of the key storage tag illustrated in FIG. 1, showing the key blank removed from the key storage tag and particularly illustrating the key shape silhouette underlying the key blank.

As illustrated in FIG. 7, a black silhouette 48 is imprinted on the upper surface of tag main body 20 and key to tag interface 22 enabling a user to verify that the particular key blank affixed to that particular key storage tag does in fact have the correct configuration or silhouette as indicated by the key storage tag.

As illustrated in FIG. 4, the lower surface of junction body 24 includes a UPC code designated by reference number 50 for facilitating inventory control at the checkout counter or other point of sale.

As illustrated in FIG. 6, the key storage tag plus key blank combination of the present invention is primarily intended for use in a key duplication cassette 52 forming a part of a key cutting machine as disclosed in allowed patent application Ser. No. 07/425,731, filed on Oct. 19, 1989, and entitled "KEY CUTTING MACHINE AND METHOD," the disclosure of which is incorporated by reference.

Because key cutting machine cassette 52 will accept a single-sided key blank as illustrated in FIG. 6 either with a correct or incorrect up/down orientation, it is important to assist the user in providing the proper key blank orientation as the key blank is inserted into cassette 52. To meet this objective as illustrated in FIG. 3, the upper surface of junction body 24 includes a pair of arrows indicating the way in which the key blank should be inserted into cassette 52 as well as the designation "Up" for the purpose of advising the user that this side of the key storage tag should be maintained "up" relative to the user to thereby ensure proper orientation of the key blank relative to the key cutting cassette 52.

An additional feature of the invention as illustrated in FIG. 3 is that junction body 24 of key storage tag 10 includes a numerical designation of the key blank affixed to the tag or, as illustrated in FIG. 3, key blank number "8."

During the key duplicating process, an operator determines the proper key blank number and accesses the key storage container 18 which prominently displays the same key blank numerical code in a visible position on the exterior surface of key storage container 18. The operator then merely reaches, up, grasps the edge of junction body 24 and removes the selected key storage tag 10 from key storage container 18 as illustrated in FIG. 8. Due to the stacked relationship of the plurality of key storage tags 10 with key blanks as illustrated in FIG. 8, the next key storage tag becomes immediately available for selection and use.

To facilitate gripping of the key storage tag and its removal from key storage container 18, the entire hinged junction 46 between junction body 24, tag main body 20 and key to tag interface 22 is creased or lightly scored. This particular configuration of the invention allows the entire junction body 24 to be deflected downwardly as illustrated in FIG. 2 during the key storage tag removal process as illustrated in FIG. 8. The arrow designated by reference number 54 in FIG. 8 illustrates the manner in which junction body 24 is downwardly deflected as the entire key storage tag 10 is removed from key storage container 18.

Key storage tag 10 is typically manufactured from a single sheet of material, preferably a single sheet of stiff paper or cardboard, fairly thin in depth as illustrated in FIGS. 2 and 5. Alternatively, key storage tag 10 could be fabricated from other more durable, but more costly materials such as plastic as well as numerous other materials.

The desired operation of hinge 46 is facilitated by appropriate placement of scoring lines along lateral axis 28 to accomplish the desired modes of deflection as described above. As clearly illustrated in FIG. 6, hinge 46 is structured so that a key duplication machine operator can, without physical restriction from either tag main body 20 or key to tag interface 22, grip both the upper and lower sides of key blank 12.

During key duplication operations, tag main body 20 can either be deflected ninety degrees, one hundred and eighty degrees or any other relative deflection away from the key blank 12. The key storage tag 10 thus remains attached to key blank 12 during key duplication operations and during the subsequent sale transaction to assist the operator in maintaining the key blank with the proper orientation relative to cassette 52 and to facilitate a cashier in scanning the key storage tag UPC code. By design, key storage tag 10 will typically not be removed by the customer until after the sale and payment transactions have been completed.

After removal of the key storage tag 10 and key blank 12 from key storage container 18, the operator can readily replace the key storage tag 10 with key blank 12 back into key storage container 18 if a selection error has been made. To facilitate this operation, the upper front surface of key storage container 18 is left open to receive unused key storage tags.

As illustrated in the drawings, the perimeter of key blank head 14 is typically centered about the intersection of the longitudinal and lateral axes 26 and 28 of key storage tag 10 with the edge of key head 14 placed in close proximity to hinge line 46. This configuration is maintained regardless of the relative physical size of key blank 12, its head 14 or its blade 16. The only constraint is that the overall size and area of key blank 12 not exceed the overall area of the combined surfaces of tag main body 20 and key to tag interface 22.

A direct result of these unique structural limitations is that key blanks having a virtually unlimited number of different geometric configurations can be secured to and used with key storage tag 10 which utilizes a single size, shape and area configuration entirely compatible with the interior dimensions of key storage container 18 as illustrated in FIG. 8.

In alternative embodiments of the present invention, hinge 46 could be fabricated differently, but such different configurations would typically require more complex structure involving higher cost manufacturing operations. For example, a conventional hinge structure as used in the doors of domestic homes including a shaft and alternating cylindrical elements maintained in alignment as is the case with a piano hinge could be substituted for hinge 46. Rather than having the particular linear hinge configuration illustrated in the drawings, hinge 46 could be configured to have a serrated edge or another shape as long as the hinge structure maintained the ability to provide the required relative deflection between various elements of key storage tag 10 as described above.

As shown in the drawings, the longitudinal axis of the key blank has been maintained generally parallel with and in fact centered about longitudinal axis 26 of key storage tag 10. Although this configuration represents the preferred embodiment of the invention, the key blank could be skewed relative to key storage tag 10. In other embodiments of the invention, key to tag interface 22 could be laterally displaced away from the centerline of key storage tag 10 without deviating from the scope of the invention as claimed. Numerous other such minor modifications of the structure of the preferred embodiment of the invention as described above could readily be implemented by one of ordinary skill in the art while still practicing the invention disclosed and claimed herein.

Referring now to FIGS. 10–16, key storage container 18 includes a longitudinal axis 56 and a vertical axis 58. Key storage container 18 is designed to receive, store and dispense along longitudinal axis 56 a supply of identical key storage tags 10 each of which holds an identical key blank 12 having a first area. The flat surface of key storage tag 10 includes an area greater than the area of key blank 12.

Figure 16:
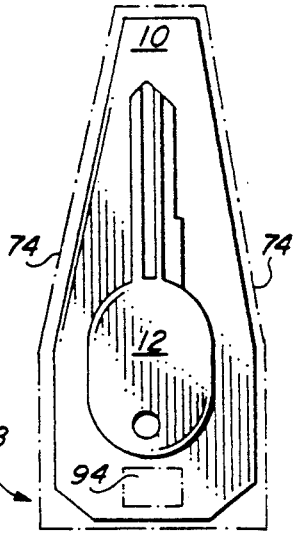
FIG. 16 represents a sectional view from above of a key storage container of the type illustrated in FIG. 14, particularly illustrating the dimensional relationships between the key storage tag and the interior storage volume of the key storage container.

Key storage container 18 includes a horizontally oriented base 60 which defines an area which in the preferred embodiment of the invention only slightly exceeds the area of key storage tag 10 as illustrated in FIG. 16.

Figure 10:
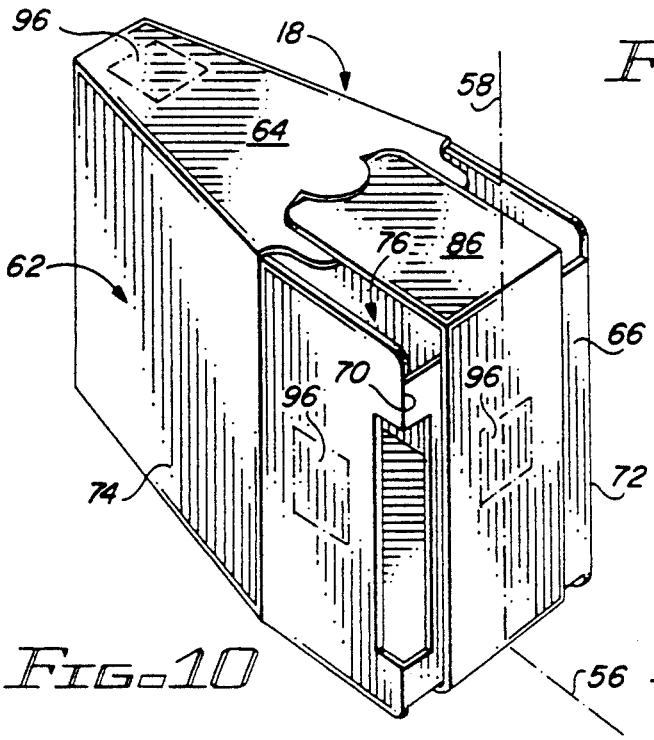
FIG. 10 represents a perspective view of a key storage container of the present invention.
Figure 12:
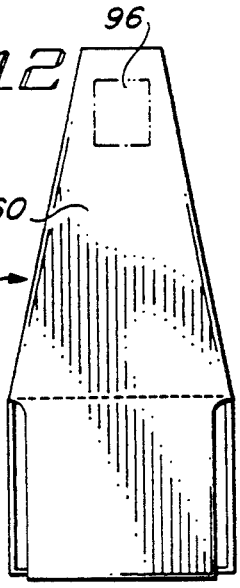
FIG. 12 represents a bottom view of the key storage container illustrated in FIG. 10.
Figure 13:
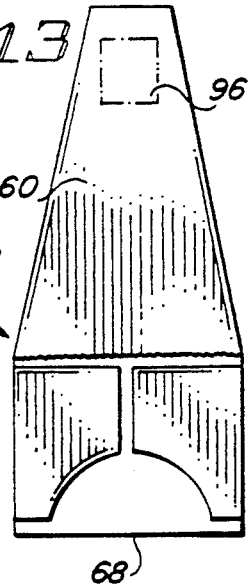
FIG. 13 represents a bottom view of the key storage container illustrated in FIG. 14 shown with the cover removed from the remainder of the key storage container.
Figure 14:
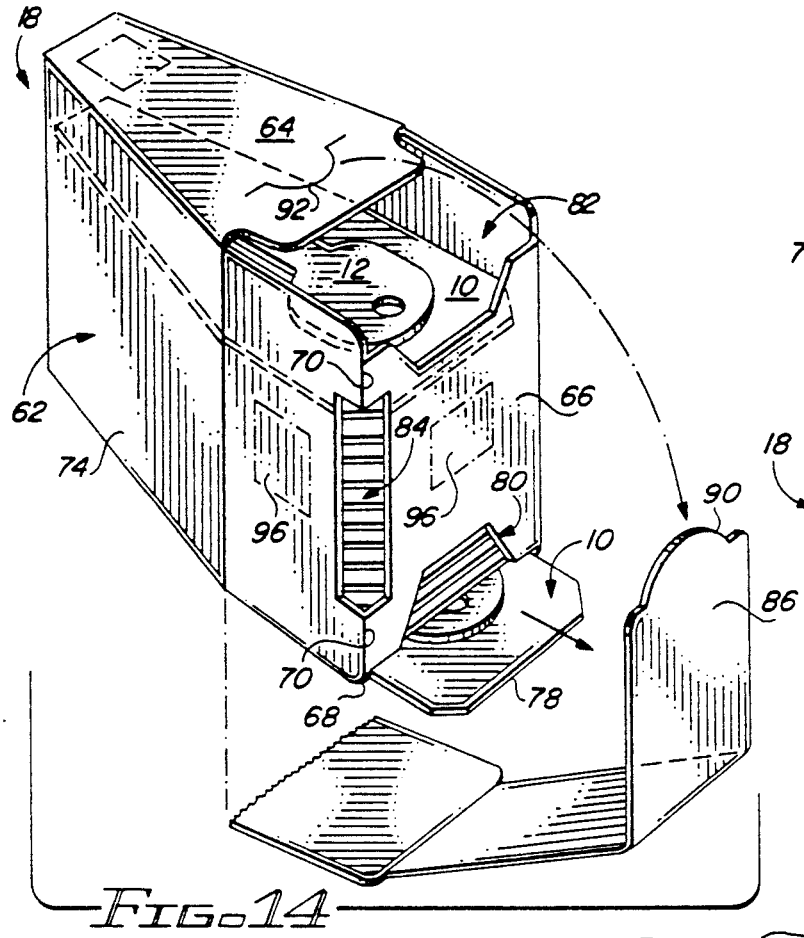
FIG. 14 represents a perspective view of the key storage container of the present invention particularly illustrating the detachable cover and a vertical stack of key storage tags positioned within the storage volume of the container.

As illustrated in FIGS. 10 and 14, key storage container 18 includes a vertically oriented sidewall 62 having a height defined by base 60 and a top surface 64.

Figure 11:
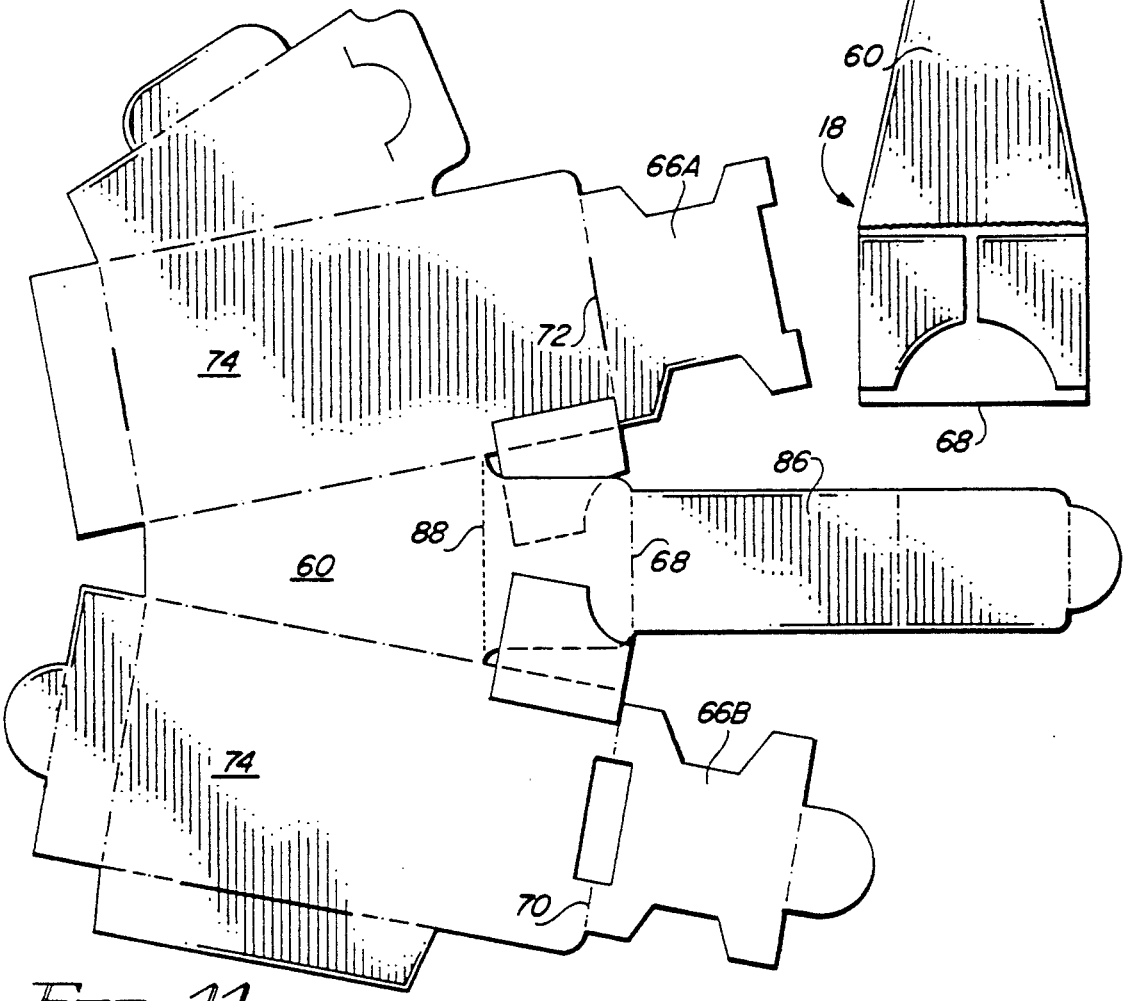
FIG. 11 illustrates the key storage container in an unfolded configuration prior to assembly into the configuration illustrated in FIG. 10.

Sidewall 62 can be subdivided into a first sidewall segment 66 formed by the superposition of flaps 66A and 66B as illustrated in FIG. 11. First sidewall segment 66 is aligned with and extends vertically upward from the base front edge 68 and includes a first vertically oriented edge surface 70 and a second vertically oriented edge surface 72.

Second sidewall element 74 is coupled to and extends vertically upward from base 60 and is coupled to the first edge surface 70 and the second edge surface 70 of first sidewall segment 66.

The entire sidewall 62 including first sidewall segment 66 and second sidewall segment 74 defines an internal storage volume generally indicated by reference number 76 for holding a supply of key storage tags 10 in alignment in a vertical stack including a lowest key storage tag designated by reference number 78 in FIG. 14.

A dispensing aperture 80 is located at the junction of the first sidewall segment 66 with base 60. Dispensing aperture 80 includes a height and a width sufficient to allow the maximum cross sectional area of the lowest key storage tag 80 (as defined by the combined cross sectional areas of the tag itself plus key blank 12) to be longitudinally displaced along base 60 of storage volume 76 through the dispensing aperture 80. The height of dispensing aperture 80 is typically limited so that only a single key storage tag 10 can pass through the aperture at one time as illustrated in FIG. 14.

Top surface 64 of key storage container 18 is coupled to the second sidewall segment 74 for the purpose of at least partially closing storage volume 76 from above.

As illustrated in FIG. 14, key storage container 18 includes a reloading aperture 82 disposed between top surface 64 and sidewall 62 and dimensioned to allow key storage tags 10 to be longitudinally displaced through reloading aperture 82 into the storage volume 76 to thereby increase the number of key storage tags 10 stored in the vertical stack. The height of the free space between the highest key 12 and top surface 64 is typically limited to prevent the key storage tags (typically ten units) from being inverted during handling and shipping prior to customer use.

An inventory viewing slot 84 is disposed in sidewall 62 to allow customer inspection of the height of the stack of key storage tags 10 located within storage volume 76.

In the preferred embodiment of the invention illustrated in the drawings, inventory viewing slot 84 is disposed in part in first sidewall segment 66 and in part in second sidewall segment 74. In alternative embodiments of the invention, inventory viewing slot 84 could readily be relocated to any other position from which one could readily inspect the height of the stack of key storage tags 10.

As illustrated in FIGS. 10 and 14, key storage container 18 includes a detachable cover 86 for temporarily closing off dispensing aperture 80 and reloading aperture 82. Cover 86 is originally formed as a part of key storage container 18 to maintain a closed package for the enclosed stack of key storage tags 10. As illustrated in FIG. 14, the lower portion of cover 86 is coupled to base 60 of key storage container 18 by serrated, tearable junction 88. The upper edge 90 of cover 86 is inserted within a flap 92 in top surface 64 of key storage container 18. This configuration of cover 86 allows it to be easily pulled back as illustrated in FIG. 14 and to be subsequently removed entirely from key storage container 18 by ripping cover 86 along serrated junction 88.

Removal of cover 86 fully exposes dispensing aperture 80 and reloading aperture 82 as illustrated in FIG. 10.

Although key blank 12 itself is not typically imprinted with any numerical data designating the particular type or style of key blank, such numerical data is typically imprinted within the rectangular block of key storage tag 10 designated by reference number 94. In order to facilitate identification of the type of key blanks stored within key storage container 18, a similar numerical designation is imprinted at a number of different locations on key storage container 18 as indicated by reference number 96.

If during key duplicating operations, a particular numerically designated key blank is removed from key storage container 18 and represents either an incorrect key blank or for some other reason is not used, such an unused key storage tag 10 can readily be reinserted through reloading aperture 82 into the internal storage volume 76. Reloading aperture 82 is accordingly dimensioned to receive and pass whatever particular configuration of key storage tag 10 is actually used.

Figure 15:
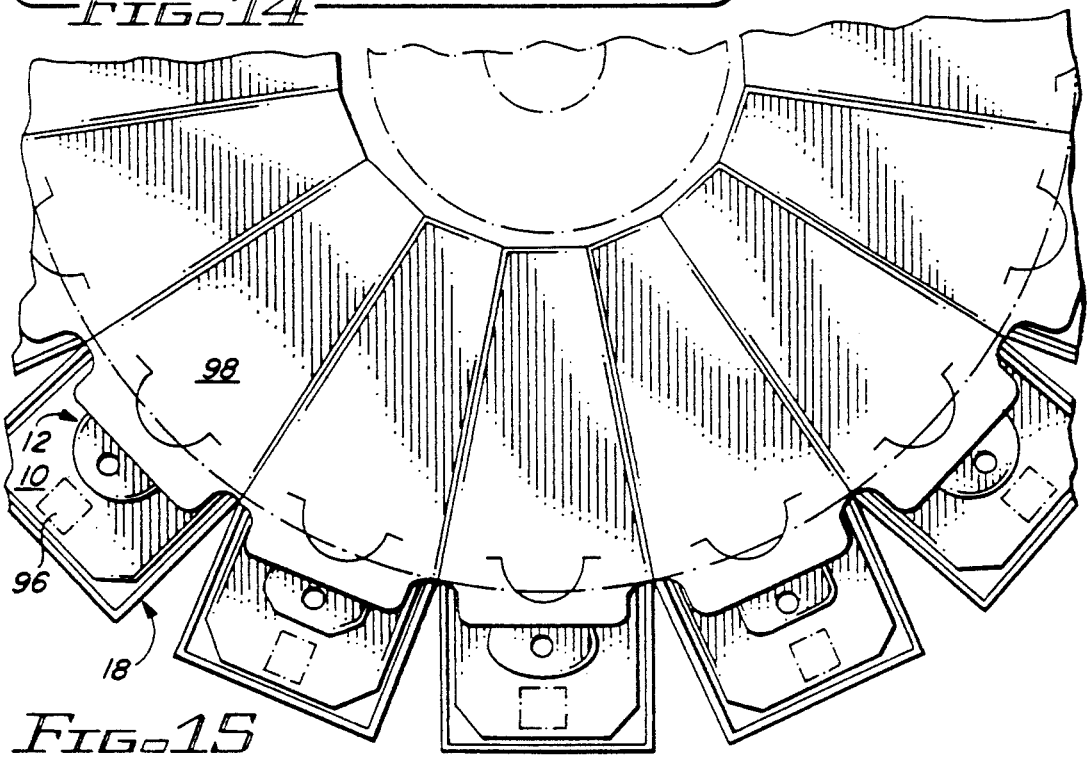
FIG. 15 illustrates a plurality of pie-shaped key storage containers inserted into pie-shaped storage slots in a rotary or carousel type storage container.

As shown by the drawings, the preferred embodiment of the key storage tag 10 and key storage container 18 is essentially pie-shaped to facilitate insertion into the pie-shaped receptacles or slots 98 in a circular or carousel type storage and dispensing system as illustrated in FIG. 15.

FIG. 11 generally illustrates how the presently preferred embodiment of the invention can be fabricated from a single sheet of stiff paper or cardboard. This particular design reduces the cost of both labor and materials and renders the key storage container fully disposable after it has been emptied of its inventory of stacked key storage tags. The system of the present invention also facilitates warehousing, customer restocking and related supply activities. Upon depletion of the contents of a single key storage container, the key storage container is merely removed from receptacle 98 of the carousel type dispenser and is replaced with a new key storage container after cover 86 has been removed.

The systematized approach of the present invention to storing and dispensing key blanks essentially renders obsolete the prior art system of providing individual key blanks in cellophane bags which must be manually sorted and stocked onto key hooks.

Figure 17:
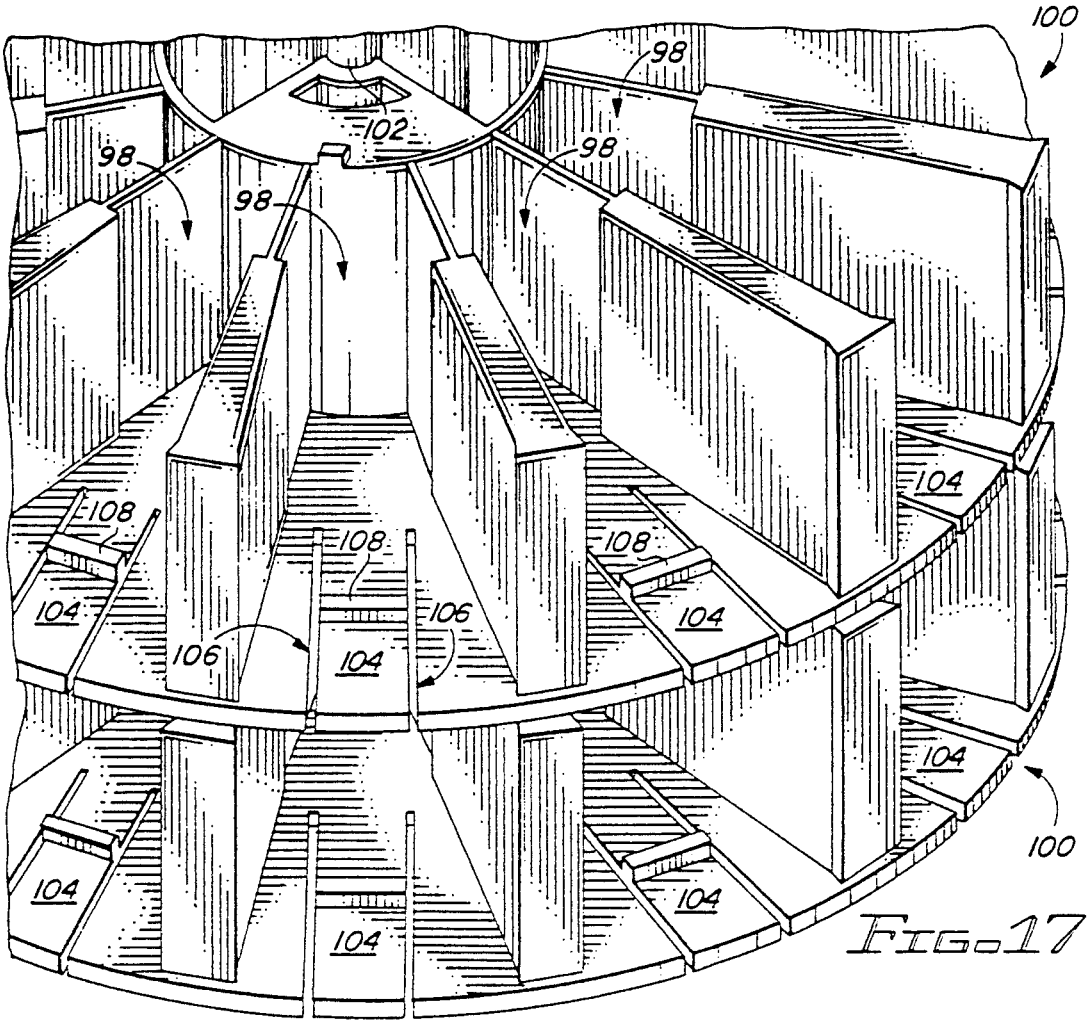
FIG. 17 is a partially cutaway perspective view illustrating a pair of stacked, rotary or carousel storage containers for receiving the pie-shaped key storage containers of the present invention.
Figure 18:
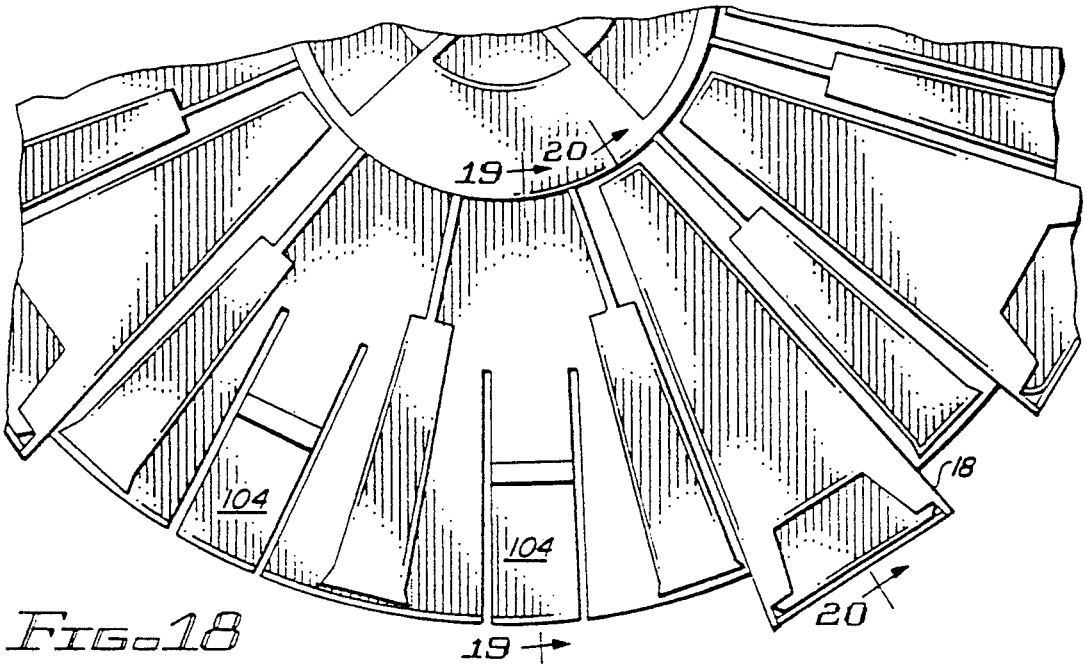
FIG. 18 is a partially cutaway view from above of the rotary storage containers illustrated in FIG. 17.

Referring now to FIGS. 17 and 18, a pair of vertically stacked, rotary carousals or storage containers 100 are rotatable about a centrally located, common shaft 102 and include a number of pie-shaped receptacles or slots 98 for receiving the compatibly shaped key storage containers 18.

The base of each slot 98 includes a vertically displaceable, spring-like locking member 104 which, like rotary storage container 100, is fabricated from plastic and is therefore relatively resilient. The elongated gaps 106 incorporated between the sides of locking member 104 and the base of each slot 98 create a spring-like locking member 104 to facilitate inserting and removing the key storage container 18.

Figure 19:
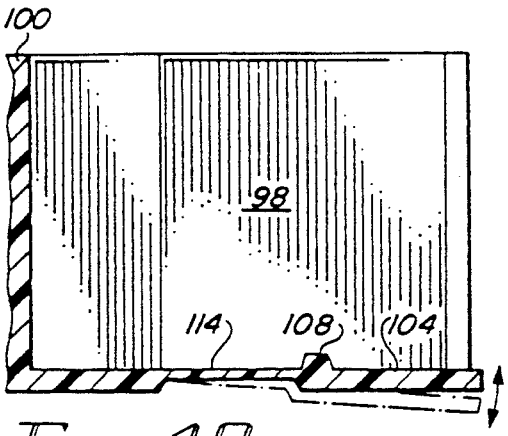
FIG. 19 is a partially cutaway sectional view of the rotary storage container illustrated in FIG. 18, taken along section lines 19—19.
Figure 20:
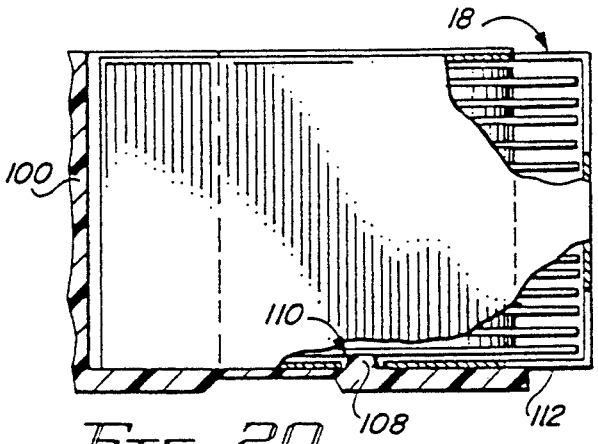
FIG. 20 is a sectional view of the rotary storage container illustrated in FIG. 18 taken along section lines 20—20, particularly illustrating the interface between pie-shaped key storage container 18 and a single slot in the rotary storage container.
Figure 21:
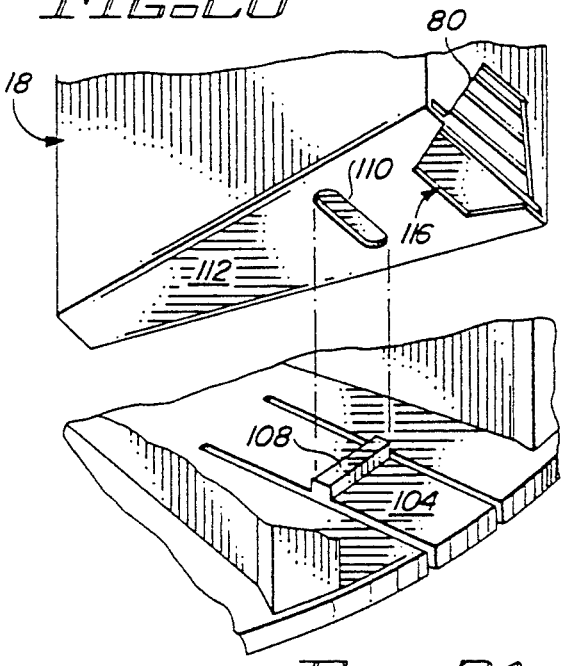
FIG. 21 represents a partially cutaway perspective view illustrating the manner in which the base of a key storage container interfaces and locks with a slot in the rotary storage container.

The upper surface of each locking member 104 includes an upwardly extending locking element 108 which is best illustrated in the FIG. 19 sectional view and in the FIG. 21 perspective view. Locking element 108 interfaces with an oval-shaped aperture 110 in the base 112 of key storage container 18 to interlock key storage container 18 into each slot 98 as illustrated in FIG. 20. The decreased thickness section of locking member 104 designated by reference number 114 in FIG. 19 enhances the vertical deflectability of locking member 104 and allows it to be deflected between the locked configuration illustrated in solid lines in FIG. 19 and the unlocked position illustrated in dotted lines in FIG. 19.

Figure 22:
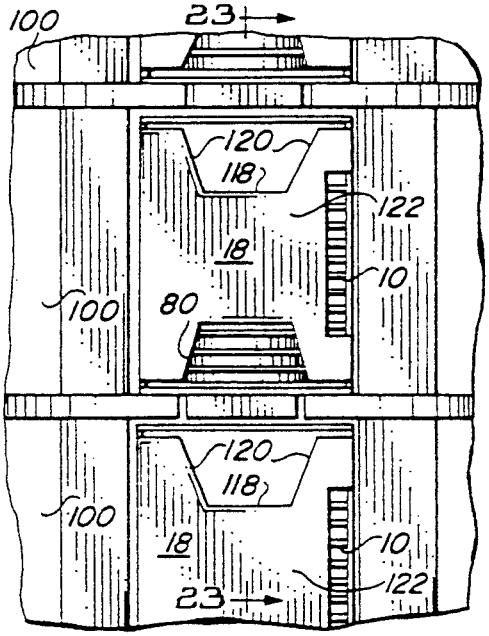
FIG. 22 is a front elevational view of a set of three stacked rotary storage containers each including a series of three vertically stacked sets of slots with a key storage container inserted in each slot.
Figure 23:
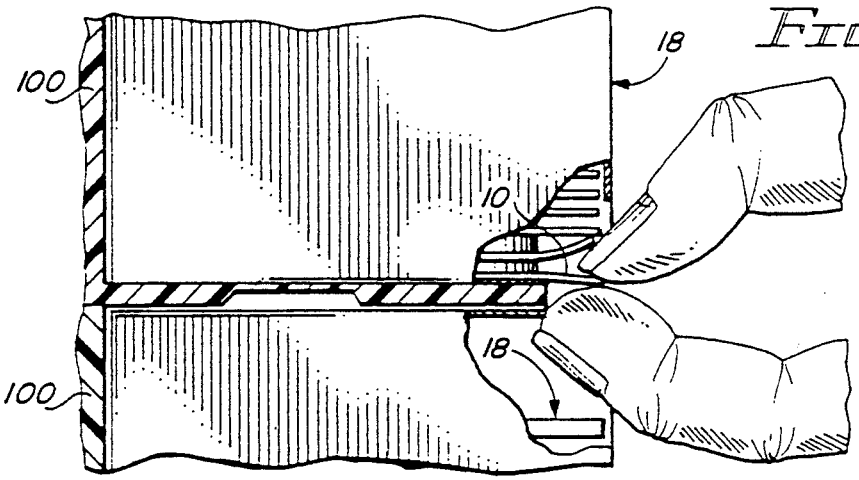
FIG. 23 is a partially cutaway side elevational view of the stacked rotary storage containers and key storage containers illustrated in FIG. 22, taken along section lines 23—23.

Another unique aspect of the design of key storage container 18 and its interface with rotary storage containers 100 is illustrated in FIGS. 21, 22 and 23. As shown in FIG. 21, dispensing aperture 82 is aligned with a cutout or notched section in base 112 of key storage container 18 designated by reference number 116. As illustrated in FIG. 23, cutout 116 allows a user to grip the lower surface of the lowest key storage tag 10 in the stack of key storage tags held in inventory in key storage container 18.

Although FIG. 20 illustrates that key storage tags can be stacked to the full height of the interior of key storage container 18, this is neither the normal or preferred configuration. In normal circumstances, each key storage container 18 typically holds on the order of about ten key storage tags such that the height of the maximum inventory of key storage tags within the interior of key storage container 18 is as illustrated in FIG. 22 no higher than the lowest level 118 of the notched cutout 120 in the vertically oriented, front face 122 of key storage container 18.

FIGS. 21–23 illustrate how dispensing aperture 80 in the front face 122 of an upper key storage container 18 cooperates with the compatible notched cutout designated by reference numbers 118 and 120 of an underlying key storage container 18. As illustrated FIG. 23, the resulting gaps, both above and below the lowest key storage tag 10, allows space for a finger of an operator to contact the upper surface of the lowermost key storage tag 10 in a key storage container 18 and a thumb to extend into the vacant uppermost section of the key storage container 18 disposed immediately below to grip the key storage tag from below. This unique configuration maximizes user friendliness of the system and permits a system user to readily grip and remove the lowermost key storage tag 10 from a series of vertically stacked key storage containers 18.

When the inventory of key storage tags 10 within a given key storage container 18 has been exhausted, the user grips the outermost edge of locking member 104, deflects it downwardly as illustrated in FIG. 19 and slides the empty key storage container horizontally outward from the rotary storage container 100. A new, full capacity key storage container 18 is then inserted into the slot and is automatically locked into place by the interlocking relationship between locking element 108 and aperture 110 in the base 112 of key storage container 18.

It will be apparent to those skilled in the art that the disclosed key storage container and the related key storage tag may be modified in numerous ways and may assume many embodiments other than the preferred forms specifically set out and described above. Accordingly, it is intended by the appended claims to cover all such modifications of the invention which fall within the true spirit and scope of the invention.

We claim:

1. A key storage container for receiving, storing and dispensing along a longitudinal axis a supply of identical key storage tags each holding a key blank having a first area, each key storage tag having a length, a front edge, a rear edge, opposing side edges defining a width, a second area greater than the first area and a maximum cross sectional area, the key storage container comprising:

a. a horizontally oriented base defining a third area greater than the second area and having a front edge and a perimeter edge;

b. a vertically oriented sidewall having a sidewall height defining a storage volume for holding a supply of key storage tags in alignment in a vertical stack including a lowest key storage tag supported directly by the base and including i. a first sidewall segment aligned with and extending vertically upward from the base front edge and including first and second edge surfaces;

ii. a second sidewall segment coupled to and extending vertically upward from the base and coupled to the first and second edge surfaces of the first sidewall segment;

c. a top surface coupled to the second sidewall segment for at least partially closing off the storage volume from above; and d. a dispensing aperture located at the junction of the first sidewall segment with the base and including a height and a width sufficient to allow the maximum cross sectional area of the lowest key storage tag to be longitudinally displaced along the base of the storage volume through the dispensing aperture.

2. The key storage container of claim 1 including a reloading aperture disposed between the top surface and the sidewall and dimensioned to allow key storage tags to be longitudinally displaced through the reloading aperture into the storage volume to increase the number of key storage tags stored in the vertical stack.

3. The key storage container of claims 1 or 2 wherein the vertical stack of key storage tags includes a height and further includes an inventory viewing slot disposed in the sidewall to allow inspection of the height of the stack of key storage tags.

4. The key storage container of claim 3 wherein the inventory viewing slot is disposed at least in part in the first sidewall segment.

5. The key storage container of claim 4 wherein the inventory viewing slot is disposed at least in part in the second sidewall segment.

6. The key storage container of claim 1 further including a cover for temporarily closing off the dispensing aperture.

7. The key storage container of claim 2 further including a cover for temporarily closing off both the dispensing aperture and the reloading aperture.

8. The key storage container of claim 1 wherein the second sidewall segment includes opposing sidewall segments and an end sidewall segment.

9. The key storage container of claim 8 wherein the first and second sidewall segments form a substantially pie-shaped container.

10. The key storage container of claim 9 wherein the key storage tag includes a substantially pie-shaped perimeter.

11. The key storage container of claims 1 or 10 wherein the third area of the base is only slightly greater than the second area of the key storage tag to allow the key storage tags to be freely vertically displaced within the storage volume.

12. The key storage container of claim 2 wherein the height of the sidewall is configured to form a storage volume adequate to receive and store a vertical stack including ten key storage tags.

13. The key storage container of claim 2 wherein the first sidewall segment includes a height and includes upper and lower surfaces and wherein the lower surface of the first sidewall segment is offset above the base and wherein the upper surface of the first sidewall segment is offset below the top surface of the key storage container.

14. The key storage container of claim 1 wherein the key blank includes a head with upper and lower surfaces and a blade with upper and lower surfaces and wherein the key storage tag includes:

a. a substantially planar tag main body having first and second spaced apart linear junction elements;

b. a key to tag interface including means for detachably coupling the interface to the lower surface of the key head and a third junction element;

c. a junction body having a linear junction surface defining a lateral axis oriented perpendicular to the longitudinal axis, the junction surface including first and second junction segments for joining the junction body to the first and second junction elements of the tag main body and a third junction segment for joining the junction body to the third junction element of the key to tag interface; and d. a hinge aligned with the lateral axis for enabling the tag main body to be deflected between a key blank storage configuration where the tag main body is positioned substantially parallel to the key blank and a key duplication configuration where the tag main body is deflected away and separated from the lower surface of the key blank.

15. The key storage container of claim 14 wherein the key storage container and the tag main body, key to tag interface and junction surface of the key storage tag are each fabricated from a single sheet of stiff paper.

16. The key storage container of claim 15 wherein the key blank head overlaps both the tag main body and the key to tag interface of the key storage tag.

17. The key storage container of claim 16 wherein the key blank head does not overlap the junction body of the key storage tag.

18. The key storage container of claim 14 wherein the detachable coupling means includes an adhesive material disposed between the key to tag interface and the lower surface of the key head.

19. The key storage container of claim 14 wherein the key blank includes a longitudinal axis oriented parallel to the longitudinal axis of the key storage container.

* * * * *